US007356302B2

(12) United States Patent
Yamamoto

(10) Patent No.: US 7,356,302 B2
(45) Date of Patent: Apr. 8, 2008

(54) PAPER SUPPLY DEVICE AND IMAGE FORMING DEVICE EQUIPPED WITH SAME

(75) Inventor: Kiyonori Yamamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/306,202

(22) Filed: Dec. 20, 2005

(65) Prior Publication Data

US 2006/0198675 A1 Sep. 7, 2006

(30) Foreign Application Priority Data

Dec. 20, 2004 (JP) ..... 2004-367686

(51) Int. Cl.
*G03G 15/00* (2006.01)
*B65H 3/46* (2006.01)

(52) U.S. Cl. ..... 399/388; 399/393; 399/392; 271/9.09; 271/145; 271/171

(58) Field of Classification Search ..... 399/392, 399/388, 393, 395, 381; 400/579, 624, 625, 400/642, 645.4, 626; 347/104; 271/9.09, 271/145, 171
See application file for complete search history.

(56) References Cited

U.S. PATENT DOCUMENTS 5,624,196 A * 4/1997 Jackson et al. ..... 400/625
7,016,629 B2 * 3/2006 Ishii et al. ..... 399/258
2003/0160380 A1 * 8/2003 Choi et al. ..... 271/109
2004/0100015 A1 * 5/2004 Baker et al. ..... 271/145
2004/0169327 A1 * 9/2004 Swayze et al. ..... 271/145
2004/0257430 A1 * 12/2004 Takahashi et al. ..... 347/264
2005/0207783 A1 * 9/2005 Sugimura et al. ..... 399/111

FOREIGN PATENT DOCUMENTS

CN 1406848 A 4/2003
CN 1506772 A 6/2004
JP 2003/312872 A 11/2003

* cited by examiner

*Primary Examiner*—Matthew Luu
*Assistant Examiner*—Joshua M Dubnow
(74) *Attorney, Agent, or Firm*—Global IP Counselors, LLP

(57) ABSTRACT

A manual paper supply device is equipped with a paper shear prevention member 35 for preventing shear of the paper 9 loaded into the manual feed paper supply tray. A brush 36 is arranged on the paper shear prevention member 35 to make contact with the paper 9; and the brush 36 is arranged to form an acute angle against the paper 9 in the paper 9 feed direction G. Skewing and floating of the paper 9 are prevented accordingly when the paper 9 is set. Further, the generation of multi-feed and marking of the paper 9 is avoided.

8 Claims, 9 Drawing Sheets

PAPER SUPPLY DEVICE AND IMAGE FORMING DEVICE EQUIPPED WITH SAME

BACKGROUND OF THE INVENTION

1. Field of the Invention

The present invention relates to a paper supply device for supplying paper and an image forming device equipped with same.

2. Background Information

Image forming devices such as copying machines, printer devices, and facsimiles, are generally equipped with a paper supply device for supplying paper. These paper supply devices are equipped with a cassette paper supply unit for supplying paper from a paper supply cassette where a plurality of paper is stored, as well as a manual feed paper supply unit for supplying a comparatively small number of sheets. The paper supply devices having these types of cassette paper supply units and manual feed paper supply units are equipped with dedicated paper supply rollers that are exclusively used in each of the cassette paper supply units and manual feed paper supply units. Further, the rotating action of these paper supply rollers sends sheets of paper into the main unit of the image forming device.

Paper supply cassettes or manual feed paper supply trays, generally, are further equipped with a regulating member for regulating the position in the width direction of the paper in accordance with the size of the paper. Further, the side-to-side sliding action of the regulating member on the paper regulates the position in the width direction of the paper.

When regulating the position of the paper stored within the paper supply cassette or loaded into the manual feed paper supply tray, the paper may slip to the side (skew) or float up. When attempting to feed paper by the paper supply roller in this state, problems are generated including paper jams and mis-feeds caused by the feeding of skewed paper.

A paper supply device to avoid these types of inconveniences has been proposed, for example, in Japanese Laid Open Patent Publication No. 2003-312872. This paper supply device comprises a paper supply roller for feeding paper set in the manual feed paper supply tray, a regulating member for regulating the lateral position of the paper, and a pressing member for pressing the top edge of the paper mounted in the manual feed tray in the orthogonal direction to the paper feed direction. Accordingly, any shearing that occurs due to tilting (skew) can be regulated because the top edge of the paper is pressed down even if the paper tries to float upward when the paper position is regulated by the regulating member.

However, the conventional paper supply device requires a certain amount of weight when pressing the paper by means of the pressing member, and in particular, when there are only a few sheets set in the manual feed paper supply tray, a large amount of weight is required to press the paper. Accordingly, problems occur such as multi-feeding of the paper, and marks being produced on the paper due to the strong friction between the paper and the paper supply rollers, because the weight is applied as a load in order to feed the paper by means of the paper supply rollers, and the feeding load is greater at the time of paper supply. In addition, it will become more difficult for a user to set the paper into the manual feed paper supply tray, and thus reduce usability, because the load resistance between the paper and the pressing member will increase when a user sets paper into the manual feed paper supply tray.

SUMMARY OF THE INVENTION

An object of the present invention is to provide a paper supply device and an image forming device equipped with same that can prevent skew and floating of the paper with a simple construction when setting the paper, and avoid generating multi-feed problems and/or marks on the paper.

A paper supply device according to a first aspect of the present invention is a paper supply device for supplying paper to an image forming unit of an image forming device, and comprises a paper supply device main unit, paper storage unit, regulating member, paper supply roller, and a paper shear prevention member. The paper storage unit stores paper and is arranged in the paper supply device main unit. The regulating member regulates the width direction of the paper stored in the paper storage unit. The paper supply roller feeds the paper stored in the paper storage unit to the image forming unit. The paper shear prevention member prevents the paper from shearing and is placed above the paper stored in the paper storage unit. The paper shear prevention member further includes a brush which makes contact with the surface of the paper stored in the paper storage unit, and the brush forms an acute angle against the paper surface in the feed direction of the paper.

According to the paper supply device according to the first aspect, the load resistance against the paper can be reduced when paper is set in the paper storage unit. Accordingly, setting paper into the paper storage unit is easier and results in improved operability when paper is set. The load resistance against the set paper can be increased in the opposite direction to the feed direction of the paper. Accordingly, the shearing of the paper can be prevented in the opposite direction to the feed direction of the paper resulting in the ability to prevent skew and floating of the paper when regulating in the width direction of the paper by the regulating member.

A paper supply device according to a second aspect of the present invention is the paper supply device according to the first aspect, wherein the paper shear prevention member has a main unit that extends in the paper in the paper feed direction, and an engagement unit on the base side of the main unit that is rotatably engaged with the paper supply device main unit, and wherein the brush is arranged on at least the tip of the main unit.

According to the paper supply device according to the second aspect, paper can be fed without applying a large weight on the paper when pressing down on the paper. As a result, the feeding load is smaller at the time of supplying paper, thereby enabling the effective prevention of multi-feeding of paper and the generation of marks on the paper by the paper supply rollers.

A paper supply device according to a third aspect of the present invention is the paper supply device according to the second aspect, wherein the main unit has a curved portion that curves so as to project on the paper side, and wherein the brush is arranged from the tip of the main unit through the curved unit.

A paper supply device according to a fourth aspect of the present invention is the paper supply device according to the first aspect, wherein the paper shear prevention member is arranged in the approximate center of the paper storage unit in the width direction of the paper.

According to the paper supply device according to the fourth aspect, operability when setting paper will improve, and skew and floating of the paper can be prevented when regulating the width direction of the paper by means of the regulating member. Furthermore, multi-feeding of the paper and generation of marks on the paper by the paper supply rollers can be effectively prevented.

A paper supply device according to a fifth aspect of the present invention is the paper supply device according to the first aspect, wherein the paper shear prevention member is arranged on the regulating member.

According to the paper supply device according to the fifth aspect, operability when setting paper will improve, and skew and floating of the paper can be prevented when regulating the width direction of the paper by means of the regulating member. Furthermore, multi-feeding of the paper and generation of marks on the paper by the paper supply rollers can be effectively prevented.

A paper supply device according to a sixth aspect of the present invention is the paper supply device according to the first aspect, wherein the paper storage unit is a manual feed paper supply tray that is mounted on the paper supply device main unit so as to be openable and closable.

A paper supply device according to a seventh aspect of the present invention is the paper supply device according to the first aspect, wherein the paper storage unit is a paper supply tray that is detachable with respect to the main unit of the image forming device.

A image forming device according to an eighth aspect of the present invention comprises an image forming unit for forming an image on paper, a paper supply device for supplying paper to the image forming unit, and a fusing unit for fusing the image formed by the image forming unit onto paper. Further, the paper supply device comprises a paper supply device main unit, a paper storage unit for storing paper and which is arranged in the paper supply device main unit, a regulating member for regulating the width direction of the paper stored in the paper storage unit, a paper supply roller for feeding paper stored in the paper storage unit to the image forming unit, and a paper shear prevention member for preventing paper shear and which is arranged above the paper stored in the paper storage unit; wherein the paper shear prevention member includes a brush that makes contact with the surface of the paper stored in the paper storage unit, and the brush is arranged to form an acute angle against the paper surface in the feeding direction of the paper.

According to the present invention, operability can be improved when paper is set. Furthermore, skew and floating of the paper can be prevented when regulating the width direction of the paper. Further, multi-feeding of the paper and generation of marks on the paper by the paper supply roller can be effectively prevented.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Embodiment 1

Figure 1:
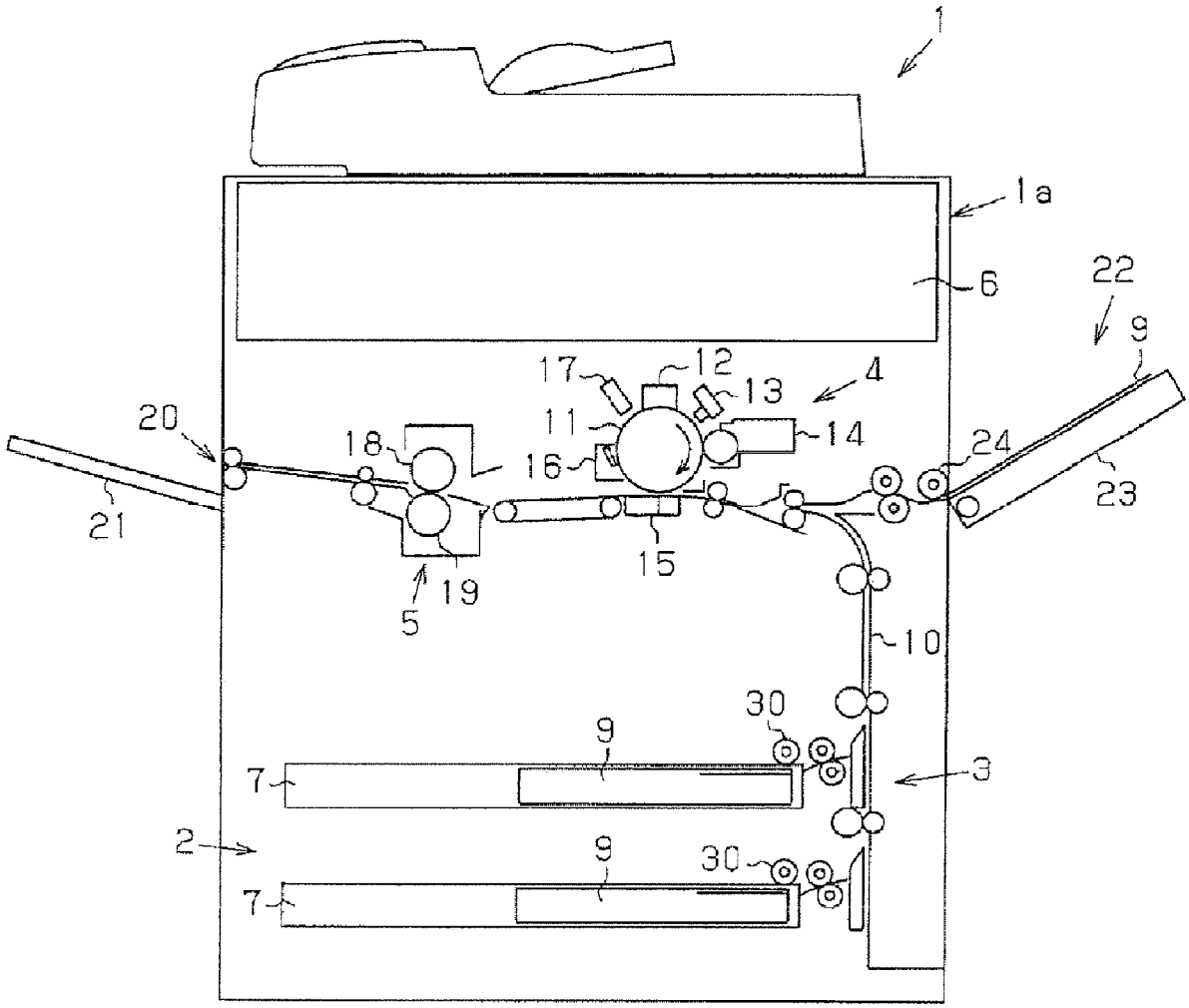
FIG. 1 shows the overall construction of an image forming device according to a first embodiment of the present invention.

A detailed description of an embodiment of the present invention is given hereinafter with reference to drawings. FIG. 1 is an outline diagram that shows the overall construction of an image forming device according to the first embodiment of the present invention.

The image forming device 1 shown in FIG. 1 is a copying machine comprising a paper supply unit 2 which functions as a paper supply device arranged beneath the device main unit 1*a*, a paper feed unit 3 arranged to the side and above the paper supply unit 2, an image forming unit 4 arranged above the paper feed unit 3, a fusing unit 5 arranged more to the discharge side than the image forming unit 4, and an image reading unit 6 arranged above the image forming unit 4 and fusing unit 5.

Figure 2:
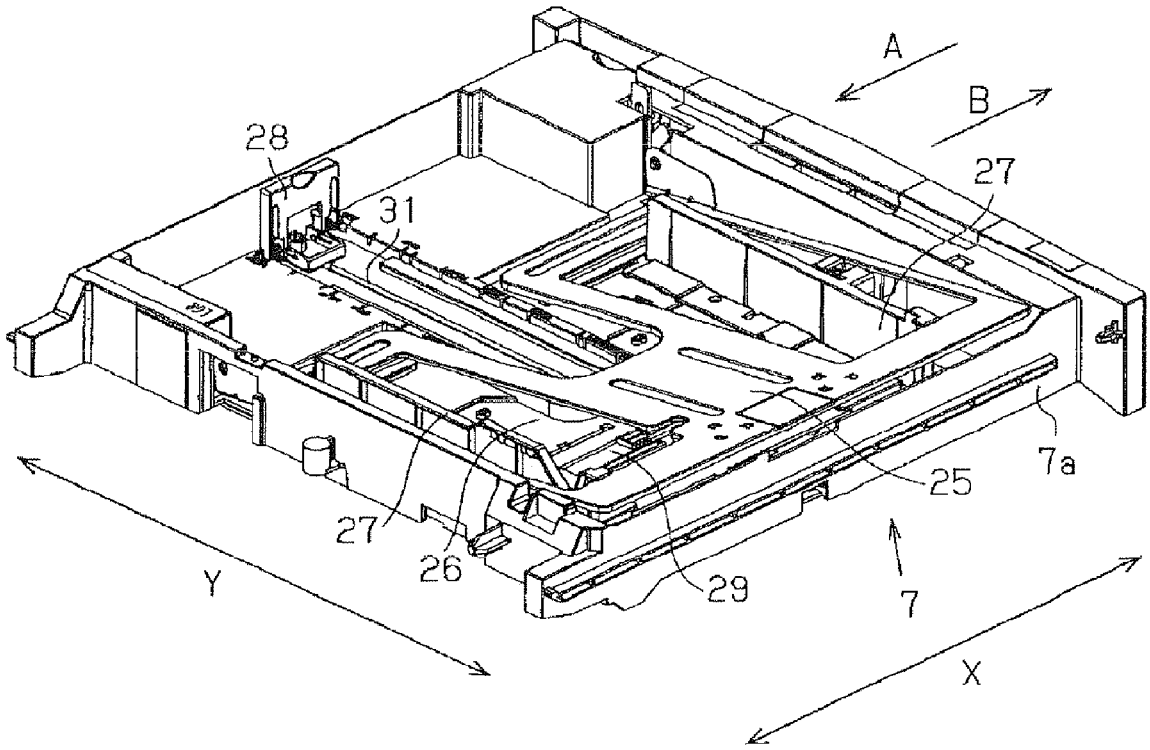
FIG. 2 shows the construction of a paper supply cassette in the image forming device according to the first embodiment of the present invention.

FIG. 2 shows the construction of the paper supply cassette in the image forming device according to the first embodiment of the present invention. The paper supply unit 2 comprises a plurality (two in the present embodiment) of paper supply cassettes 7 storing the paper 9, and paper supply roller 30 for feeding the paper 9 stored in the paper supply cassette 7. The paper supply cassette 7 is equipped, as shown in FIG. 2, with a paper loading unit 25, and the bottom 26 of the paper supply cassette 7 is equipped with a spring (not shown in drawing) for urging the paper loading unit 25 upward. The paper 9 placed on the paper loading unit 25 and stored in the paper supply cassette 7 is pressed down upon by the paper supply roller 30. A separator pad (not shown in the drawing) is pressure connected to the paper supply roller 30 by an elastic member (not shown in drawing) such as a coil spring or the like. The paper 9 is separated and fed one sheet at a time to the paper feed unit 3 by the separator pad when the paper 9 is fed by the rolling action of the paper supply roller 30 from the paper supply cassette 7 selected from among the plurality of paper supply trays 7. Moreover, the paper supply cassette 7, as shown in FIG. 2, can be attached and detached in the directions of the arrows A, B direction with respect to the device main unit 1*a*.

A position regulating mechanism is arranged in the paper supply cassette 7 for regulating the position of the paper 9 according to the size of the paper 9 stored. The position regulating mechanism, as shown in FIG. 2, comprises a pair of regulating members 27 for regulating the width direction X of the paper 9 and regulating member 28 for regulating the length direction Y of the paper 9. A groove 29 is formed at the bottom 26 of the paper supply cassette 7, and the regulating members 27 are capable of sliding in the width direction X of the paper 9 on the bottom 26 along the groove 29. The pair of regulating members 27 are constructed to regulate the position in the width direction X of the paper 9 by the successive movements in the direction to narrow or widen the width thereof according to the paper 9. A groove 31 is formed at the bottom 26 of the paper supply cassette 7, and the regulating member 28 is also capable of sliding in the length direction Y of the paper 9 on the bottom 26 along the groove 31 and regulates the position in the length direction Y of the paper 9.

Figure 3:
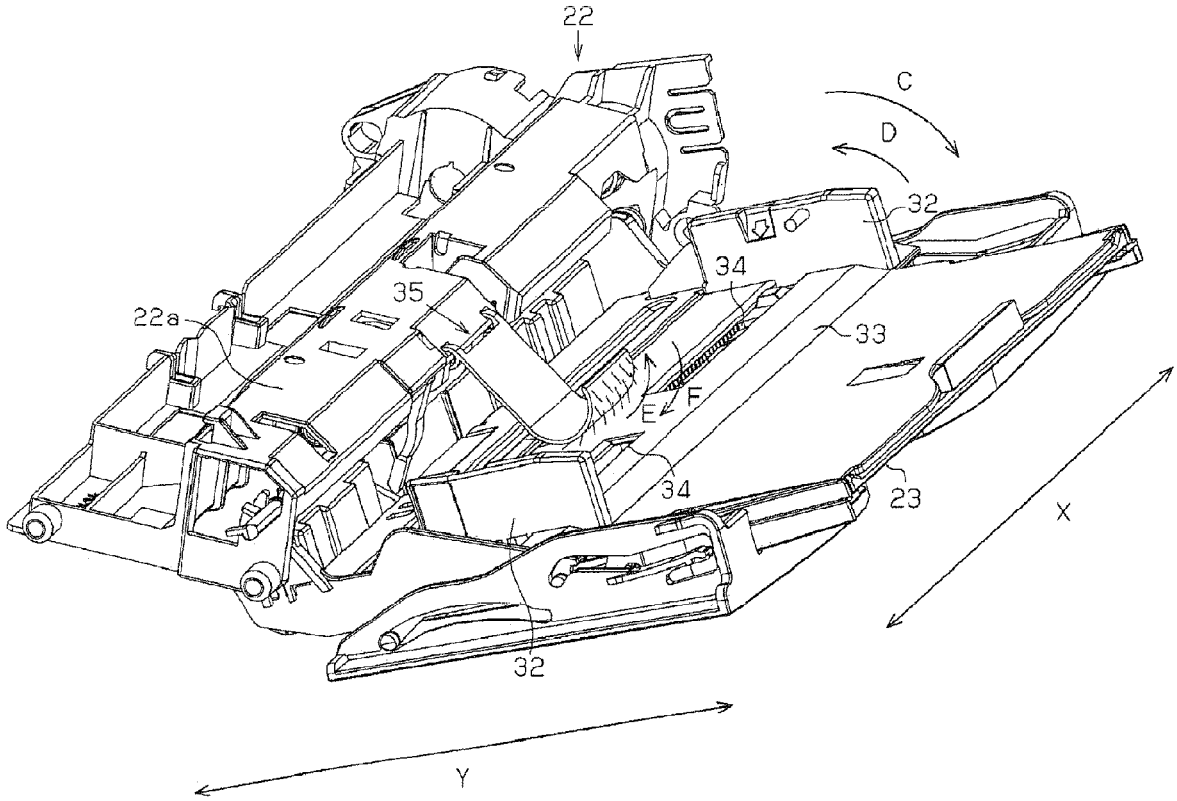
FIG. 3 shows the construction of a manual feed paper supply device in the image forming device according to the first embodiment of the present invention.

FIG. 3 shows a manual feed paper supply device in the image forming device according to the first embodiment of the present invention. A manual feed paper supply unit 22 is arranged on the image forming device 1 of the present embodiment in order to function as the manual feed paper supply device. The manual feed paper supply unit 22 comprises a manual feed paper supply tray 23, and a paper supply roller 24 for feeding the paper 9 placed in the manual feed paper supply tray 23. A separator pad (not shown in the drawing) is pressure connected to the paper supply roller 24 in the same fashion as the paper supply unit 2 given above, by an elastic member (not shown in the drawing) such as a coil spring or the like. The paper 9 is separated and fed one sheet at a time to the paper feed unit 3 by the separator pad when the paper 9 that is pressed down by the paper supply roller 24 and placed in the manual feed paper supply tray 23 is fed by the rolling action of the paper supply roller 24. Moreover, the manual feed paper supply tray 23, as shown in FIG. 3, can be freely attached and removed in the directions of the arrows C, D direction with respect to the device main unit 1*a*.

A position regulating mechanism is arranged in the manual feed paper supply tray 23 in the same fashion as the paper supply cassette 7 given above for regulating the position of the paper 9 according to the size of the paper 9 stored. The position regulating mechanism, as shown in FIG. 3, comprises a pair of regulating members 32 for regulating the width direction X of the paper 9. A groove 34 is formed at the bottom 33 of the manual feed paper supply tray 23, and the regulating members 32 are capable of sliding in the width direction X of the paper on the bottom 33 along the groove 34. The pair of regulating members 32 regulate the position in the width direction X of the paper 9 by the successive movements in the direction to narrow or widen the width thereof according to the paper 9.

The paper 9 supplied to the paper feed unit 3 is fed towards the image forming unit 4 via the paper supply feed path 10. The image forming unit 4 forms a predetermined toner image on the paper 9 by an electronic photography process, and in addition to comprising a photo-sensitive element 11 which is an image carrier arranged on an axis with the ability to rotate in a predetermined direction (the direction indicated by the arrow in the drawing), it comprises, in the vicinity of the photo-sensitive element 11 along the rotation direction thereof, an electrostatic charging device 12, photo exposing device 13, development device 14, transfer device 15, cleaning device 16, and static eliminator device 17.

The electrostatic charging device 12 provides an electrostatic wire impressed with a high voltage, and the surface of the photo-sensitive element 11 is uniformly charged by a predetermined electric potential given to the surface of the photo-sensitive element 11 by a corona discharge from the electrostatic wire. Through the photo exposing device 13, light based on image data from an original document read by the image reading unit 6 is irradiated to the photo-sensitive element 11, thereby selectively attenuating the electric potential on the surface of the photo-sensitive element 11 and forming an electrostatic latent image on the surface of the photo-sensitive element 11. Next, the development device 14 adheres toner to the electrostatic latent image and forms a toner image on the surface of the photo-sensitive element 11, where the toner image on the surface of the photo-sensitive element 11 is transferred by the transfer device 15 to the paper 9 supplied between the photo-sensitive element 11 and the transfer device 15.

The paper 9 having a toner image transferred thereto is fed to the fusing unit 5 from the image forming unit 4. The fusing unit 5 is placed on the down stream side of the paper feed direction of the image forming unit 4, and the paper 9 having a toner image transferred by the image forming unit 4 is heated and held between a heating roller 18 attached to the fusing unit 5 and a pressure roller 19 held down by the heating roller 18 where the toner image in adhered to the paper 9. The paper 9 having undergone image formation in the fusing unit 5 from the image forming unit 4 is discharged onto a discharge tray 21 by the discharge roller pair 20. Meanwhile, the residual toner on the surface of the photo-sensitive element 11 after transferring is removed by the cleaning device 16, and the residual electric charge on the surface of the photo-sensitive element 11 is removed by the static eliminator device 17. The photo-sensitive element 11 is re-charged by the electrostatic charging device 12 and image formation can be performed thereafter in the same manner.

Figure 4:
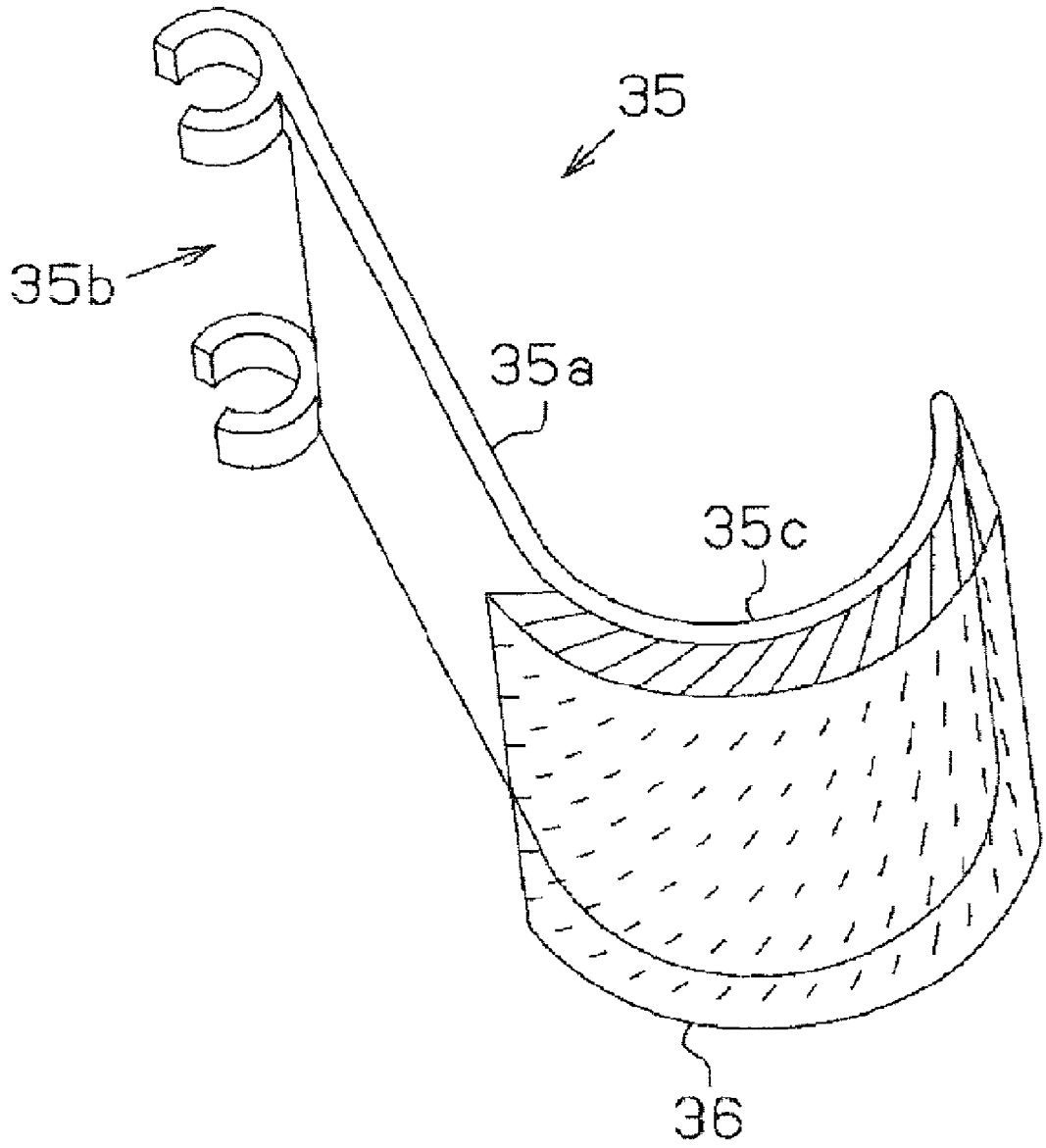
FIG. 4 shows a paper shear prevention member in the manual feed paper supply device according to the first embodiment of the present invention.
Figure 5:
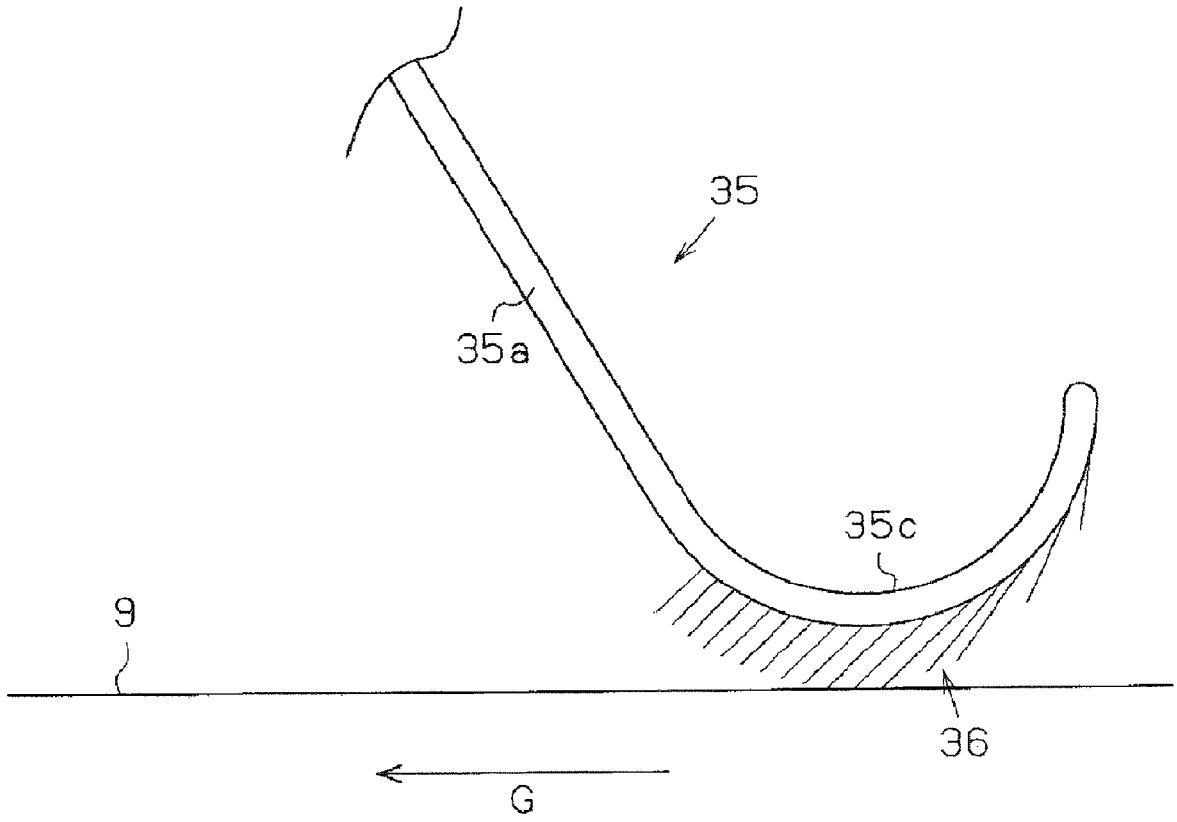
FIG. 5 describes the relationship between a sheet of paper and the paper shear prevention member in the manual feed paper supply device according to the first embodiment of the present invention.

In the present embodiment, a paper shear prevention member is arranged in the manual feed paper supply unit 22 for preventing shear of the paper 9 loaded into the manual feed paper supply tray. A detailed description is given hereinafter with reference to drawings. FIG. 4 shows the paper shear prevention member in the manual feed paper supply device according to the first embodiment of the present invention. FIG. 5 describes the relationship between a sheet of paper and the paper shear prevention member in the manual feed paper supply device according to the first embodiment of the present invention.

The manual feed paper supply unit 22 in the present embodiment, as shown in FIG. 3, includes a paper shear prevention member 35 in the approximate center of the manual feed paper supply tray 23 in the width direction X of the paper 9. The paper shear prevention member 35, as shown in FIG. 4, comprises a main unit 35*a* formed to extend in the paper feed direction and a engagement unit 35*b* which engages with the manual feed paper supply device main unit 22*a*. A curved unit 35*c* is integrally arranged on the tip end of the main unit 35*a* to protrude downward (to the paper side); and the paper shear prevention member 35, as shown in FIG. 3, is arranged in a curved state facing upwards from the bottom 33 of the manual feed paper supply tray 23.

As shown in FIG. 4, a brush 36 formed from, for instance, an acrylic resin spans from the tip of the tip end of the main unit 35*a* through the curved unit 35*c*, and makes contact with the paper 9 when the paper 9 is loaded into the manual feed paper supply tray 23. Furthermore, the paper shear prevention member 35 is rotatable in the arrow E, F directions in FIG. 3 with respect to the manual feed paper supply device main unit 22*a* through the engagement unit 35*b*.

A description is given hereinafter of the operational effects according to the paper shear prevention member 35. As described above, when placing paper 9 into the manual feed paper supply tray 23, the brush 36 arranged on the paper shear prevention member 35 makes contact with the paper 9, and even though paper 9 is set, the brush 36, as shown in FIG. 5, forms an acute angle against the paper 9 placed in the manual feed paper supply tray 23 in the feed direction G of the paper 9. Accordingly, the paper 9 can be set according to the flow of the brush 36 when loading paper 9 into the manual feed paper supply tray 23. In this way, a user can easily set paper 9 into the manual feed paper supply tray 23 because the load resistance against the paper 9 can be reduced when the user sets paper 9 into the manual feed paper supply tray 23, thereby resulting in improved operability at the time of setting paper 9.

Similarly, the load resistance against the set paper 9 can be increased in the opposite direction to the feed direction G of paper 9 because the brush 36 forms an acute angle with respect to the paper 9 loaded into the manual feed paper supply tray 23 in the feed direction G of the paper 9 (i.e. forms an obtuse angle against the paper 9 loaded into the manual feed paper supply tray 23 in the opposite direction to the feed direction G of the paper 9). Therefore, shearing of the paper 9 can be prevented in the opposite direction to the feed direction G of the paper 9, resulting in the ability to prevent skew and floating of the paper 9 when regulating in the width direction X of the paper 9 by the regulating member 32.

The present embodiment is constructed so that the paper shear prevention member 35 is rotatable with respect to the manual feed paper supply device main unit 22*a*. Accordingly, the paper 9 can be fed in a state where skew and floating of the paper 9 are prevented without applying a heavy weight onto the paper 9 when pressing the paper 9, because the weight for pressing down the paper 9 by the paper shear prevention member 35 can be reduced. As a result, multi-feed of the paper 9 and generation of marks on the paper 9 by the paper supply roller 24 can be effectively prevented because the feeding load at the time of paper supply is reduced.

The present embodiment, as described above, includes a paper shear prevention member 35 for preventing shear of the paper 9 loaded into the manual feed paper supply tray 23. The brush 36 is arranged on the paper shear prevention member 35 so as to make contact with the paper 9 loaded into the manual feed paper supply tray 23, and forms an acute angle against the paper 9. Accordingly, the load resistance against the paper 9 can be reduced when setting paper 9 into the manual feed paper supply tray 23, thereby making it easier to set paper 9 into the manual feed paper supply tray 23, and resulting in improved operability when setting paper 9. The load resistance against the set paper 9 can also be increased in the opposite direction to the feed direction G of the paper 9. Therefore, shear of the paper 9 can be prevented in the opposite direction to the feed direction G of the paper 9, resulting in the ability to prevent skew and floating of the paper 9 when regulating the width direction X of the paper 9 by the regulating member 32.

The paper shear prevention member 35 is also rotatable with respect to the manual feed paper supply device main unit 22*a*. Accordingly, the paper 9 can be fed without applying a large weight onto the paper 9 when holding down the paper 9. As a result, the feeding load at the time of paper supply can be reduced, thereby enabling effective prevention of multi-feed of the paper 9 and the generation of marks on the paper 9 by the paper supply roller 24.

The paper shear prevention member 35 is also attached in the approximate center of the manual feed paper supply tray 23 in the width direction X of the paper 9. Therefore, in addition to improving the operability when setting the paper 9, skew and floating of the paper 9 can be prevented when regulating the width direction X of the paper 9. In addition, multi-feed of the paper 9 and generation of marks on the paper 9 by the paper supply roller 24 can be effectively prevented.

Embodiment 2

Figure 6:
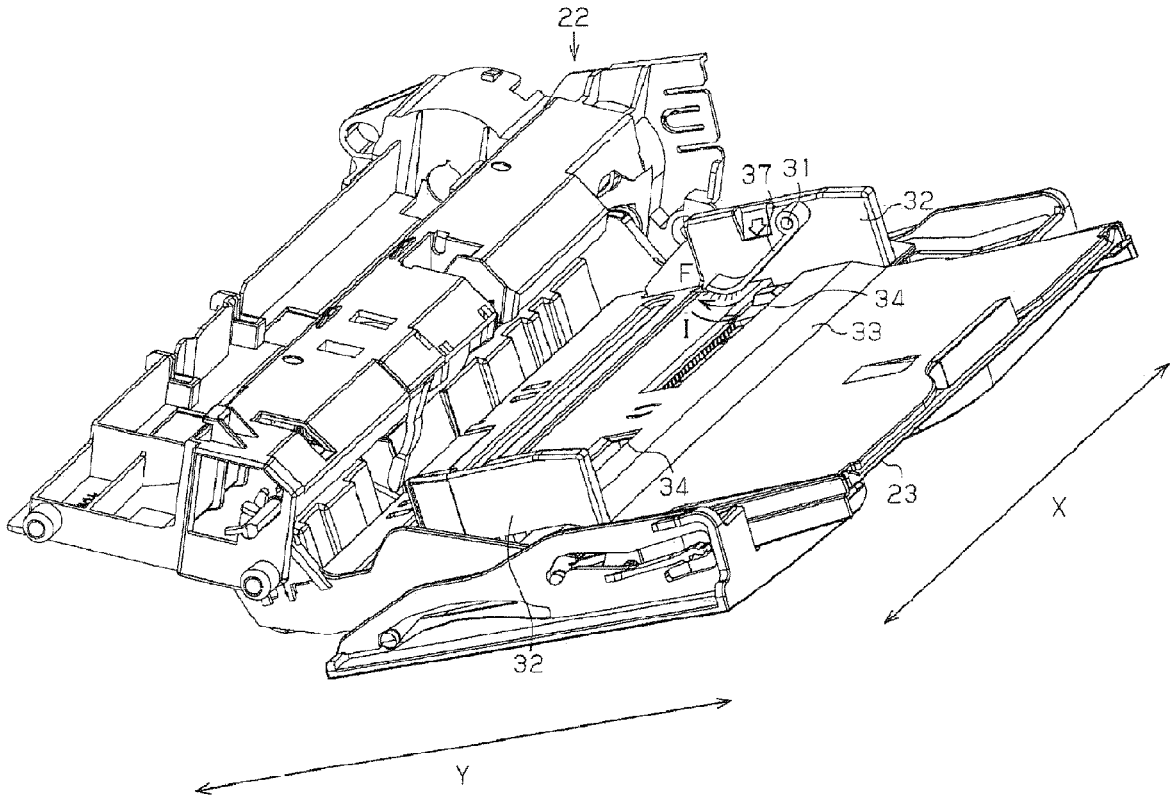
FIG. 6 shows the construction of a manual feed paper supply device in an image forming device according to a second embodiment of the present invention.
Figure 7:
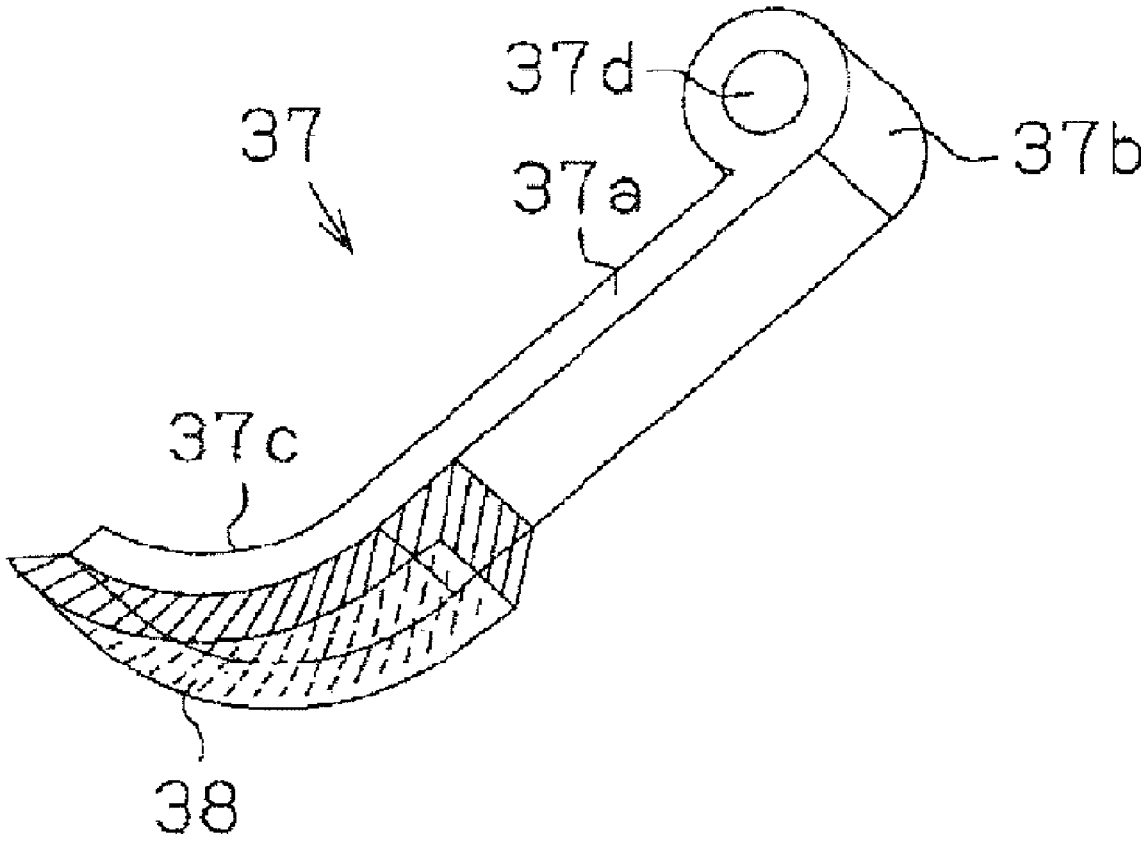
FIG. 7 shows a paper shear prevention member in the manual feed paper supply device according to the second embodiment of the present invention.
Figure 8:
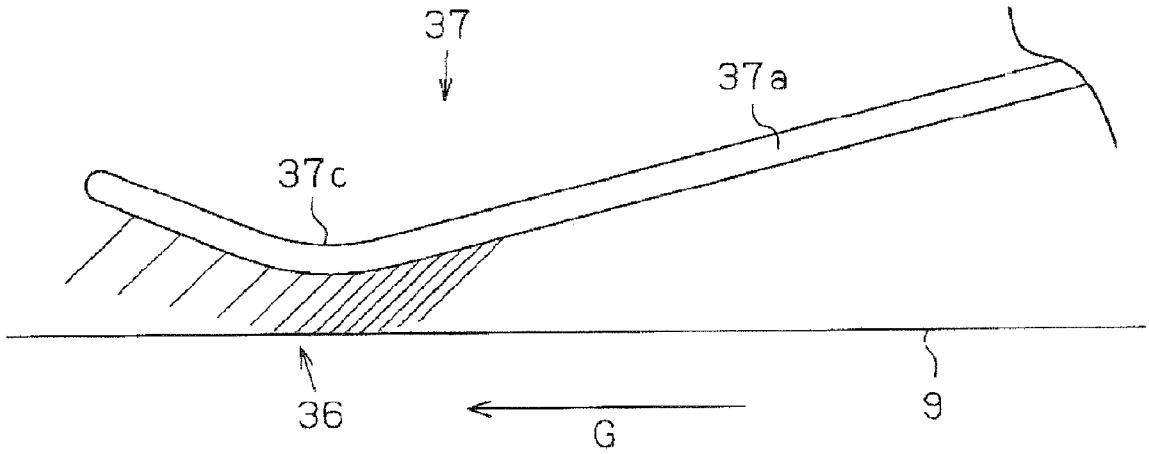
FIG. 8 describes the relationship between a sheet of paper and the paper shear prevention member in the manual feed paper supply device according to the second embodiment of the present invention.

Next, a description of the second embodiment of the present invention will be provided. FIG. 6 shows a manual feed paper supply device in an image forming device according to a second embodiment of the present invention. FIG. 7 shows a paper shear prevention member in the manual feed paper supply device according to the second embodiment of the present invention. FIG. 8 describes the relationship between the paper and the paper shear prevention member in the manual feed paper supply device according to the second embodiment of the present invention. Moreover, the same reference symbols are used for the constituent elements that are the same as in the first embodiment, and the descriptions thereof are omitted. Further, as the overall construction of the image forming device is the same as in the first embodiment, a detailed description thereof will be omitted.

As shown in FIG. 6, a paper shear prevention member 37 is arranged on a regulating member 32 for regulating the width direction X of the paper 9. The paper shear prevention member 37, as shown in FIG. 7, comprises a main unit 37*a* formed to extend in the paper feed direction and a engagement unit 37*b* which engages with regulating member 32. A curved unit 37*c* is arranged on the tip end of the main unit 37*a* to protrude downward (to the paper side); and the paper shear prevention member 37, as shown in FIG. 6, is arranged in a curved state facing upwards from the bottom 33 of the manual feed paper supply tray 23.

As shown in FIG. 7, a brush 38 is formed from, for instance, an acrylic resin, and spans from the tip of the tip end of the main unit 37*a* through the curved unit 37*c* in the same manner as with the paper shear prevention member 35 described above, and the brush 38 makes contact with the paper 9 when paper 9 is loaded into the manual feed paper supply tray 23. Further, a hole 37*d* is formed in the engagement unit 35*b* of the paper shear prevention member 37, and rotates in the arrow H, I directions in the drawing with respect to the manual feed paper supply device main unit 22*a*.

In FIG. 6, only the paper shear prevention member 37 is shown attached to the regulating member 32 on the far side of the paper surface, however, the paper shear prevention member 37 can also be attached to the regulating member 32 on the near side of the figure so as to be rotatable with respect to the manual feed paper supply device main unit 22*a*.

A description of the operational effects according to the paper shear prevention member 37 is provided below. As described above, when placing paper 9 into the manual feed paper supply tray 23, the brush 38 arranged on the paper shear prevention member 37 makes contact with the paper 9, and even though paper 9 is set, the brush 36, as shown in FIG. 8, is arranged, in the same manner as in the brush 36 described above, to form an acute angle against the paper 9 placed in the manual feed paper supply tray 23 in the feed direction G of the paper 9. Accordingly, paper 9 can be set according to the flow of the brush 38 when loading paper 9 into the manual feed paper supply tray 23. In this way, a user can easily set paper 9 into the manual feed paper supply tray 23, because the load resistance against the paper 9 can be reduced when the user sets paper 9 into the manual feed paper supply tray 23, thereby resulting in improved operability when setting paper 9.

Similarly, the load resistance against the set paper 9 can be increased in the opposite direction to the feed direction G of paper 9 because the brush 38 is arranged to form an acute angle against the paper 9 loaded into the manual feed paper supply tray 23 in the feed direction G of the paper 9 (i.e. to form an obtuse angle against the paper 9 loaded into the manual feed paper supply tray 23 in the opposite direction to the feed direction G of the paper 9). Therefore, shear of the paper 9 can be prevented in the opposite direction to the feed direction G of the paper 9, resulting in the ability to prevent skew and floating of the paper 9 when regulating in the width direction X of the paper 9 by the regulating member 32.

The present embodiment is constructed similar to that given above, so that the paper shear prevention member 37 is rotatably attached with respect to the regulating member 32. Accordingly, the paper 9 can be fed in a state where skew and floating of the paper 9 are prevented without applying a heavy weight onto the paper 9 when pressing down the paper 9, because the weight for holding down the paper 9 by the paper shear prevention member 37 can be reduced. As a result, multi-feed of the paper 9 and generation of marks on the paper 9 by the paper supply roller 24 can be effectively prevented, because the feeding load at the time of paper supply is reduced.

The present embodiment, as described above, is constructed in the same manner as the first embodiment to provide a paper shear prevention member 37 for preventing shear of the paper 9 loaded into the manual feed paper supply tray 23. The brush 38 is arranged on the paper shear prevention member 37 so as to make contact with the paper 9 loaded into the manual feed paper supply tray 23, and is constructed to form an acute angle against the paper 9. Accordingly, the load resistance against the paper 9 can be reduced when setting paper 9 into the manual feed paper supply tray 23, thereby making it easier to set paper 9 into the manual feed paper supply tray 23, and resulting in improved operability when setting paper 9. The load resistance against the set paper 9 can also be increased in the opposite direction to the feed direction G of the paper 9. Therefore, shear of the paper 9 can be prevented in the opposite direction to the feed direction G of the paper 9, resulting in the ability to prevent skew and floating of the paper 9 at the time of regulating the width direction X of the paper 9 by the regulating member 32.

The construction is further similar to that described in the first embodiment such that the paper shear prevention member 37 is attached with the ability to rotate against the manual feed paper supply device main unit 22*a*. Accordingly, the paper 9 can be fed without applying a large weight onto the paper 9 when pressing down the paper 9. As a result, the feeding load at the time of paper supply can be reduced, thereby enabling effective prevention of multi-feed of the paper 9 and the generation of marks on the paper 9 by the paper supply roller 24.

The construction is further such that the paper shear prevention member 37 is attached to the regulating member 32. Therefore, in addition to improving the operability at the time of setting the paper 9 with a simple construction, skew and floating of the paper 9 can be prevented at the time of regulating the width direction X of the paper 9. In addition, multi-feed of the paper 9 and generation of marks on the paper 9 by the paper supply roller 24 can be effectively prevented.

The embodiments given above are simply examples, and the scope of the present invention is not limited to the above embodiments. The shapes, measurements, materials, and so forth of each of the constituent elements of the present invention can be modified based on the essence of the present invention, so long as these do not depart from the scope of the present invention.

For example, the embodiments given above are constructed to attach the paper shear prevention members 35, 37 to the manual feed paper supply device 22, but a construction in which the paper shear prevention members 35, 37 are attached to the paper supply unit 2 is also acceptable. More specifically, a construction, for instance, which uses the paper shear prevention member 35 described in the first embodiment, can be used as the paper shear prevention member for preventing shear of the paper 9 stored in the paper supply cassette 7 attached to the paper supply device 2. In other words, a construction can be provided in which the paper shear prevention member 35 is attached near the center of the paper supply cassette 7 in the width direction X of the paper 9 so as to be rotatable with respect to the paper supply cassette main unit 7*a*. A construction can further be provided in which the brush 36 arranged on the paper shear prevention member 35 is arranged so as to make contact with the paper 9 stored in the paper supply cassette 7, and the brush 36 is arranged to form an acute angle against the paper 9 in the feed direction of the paper 9. The same operational effect as that of the first embodiment can be obtained with the paper supply device 2 by providing a construction in this manner.

A construction which uses the paper shear prevention member 37 described in the second embodiment can also be used as a paper shear prevention member that prevents shear of the paper 9 stored in the paper supply cassette 7 attached to the paper supply device 2. In other words, a construction can be provided in which the paper shear prevention member 37 is attached to the regulating member 27 so as to be rotatable with respect to the paper supply cassette main unit 7*a*. A construction can further be provided in which the brush 38 arranged on the paper shear prevention member 37 is arranged so as to make contact with the paper 9 stored in the paper supply cassette 7, and the brush 38 is arranged to form an acute angle against the paper 9 in the feed direction of the paper 9. The same operational effect as that of the second embodiment can be obtained with the paper supply device 2 by providing a construction in this manner.

Figure 9:
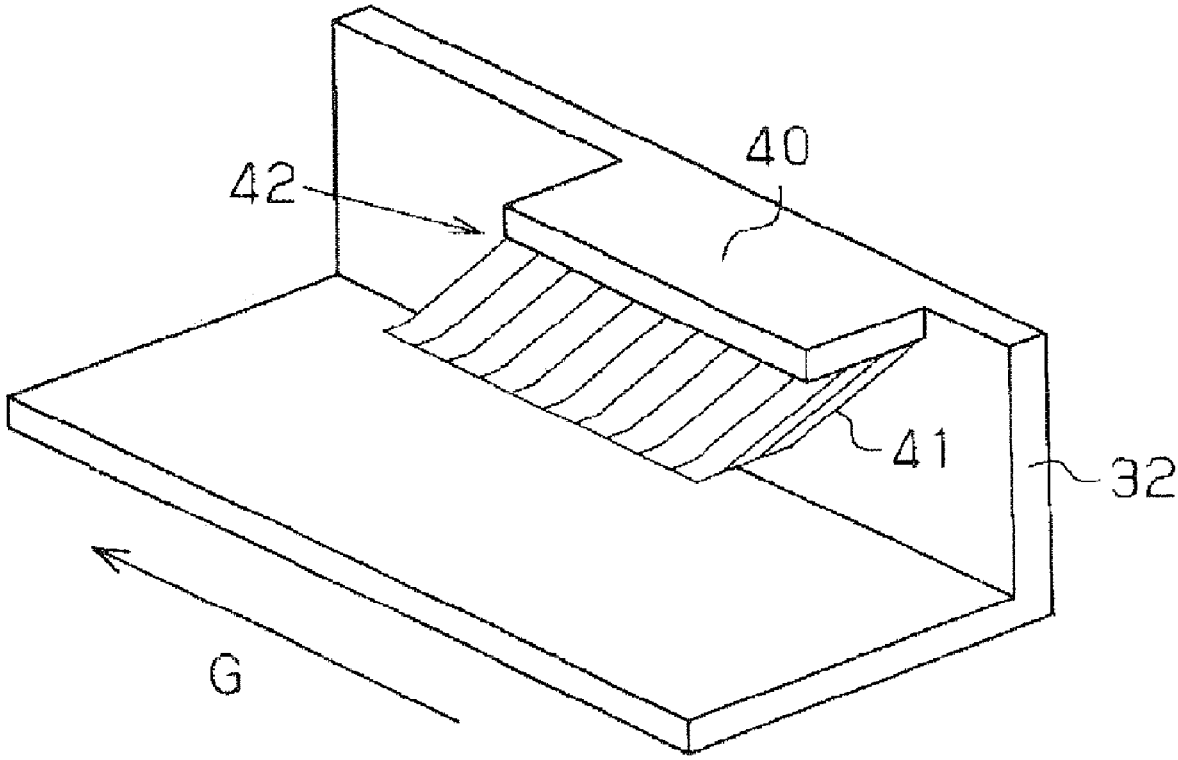
FIG. 9 shows a modified example of the paper shear prevention member in the manual feed paper supply device according to the second embodiment of the present invention.

The second embodiment given above described a construction in which the paper shear prevention member 37 is attached individually to the regulating member 32, however, a construction shown in FIG. 9 may also be used in which a paper shear prevention member 42 constructed of a main unit 40 attached to the regulating member 32 and brush 41 arranged on the main unit 40, is attached to the regulating member 32. Operability can be improved at the time of setting the paper 9, and skew and floating of the paper 9 can be prevented when regulating the width direction of the paper 9 by the regulating member 32 in the same manner as with the above embodiments, by providing a paper shear prevention member 42 in this manner. Further, costs can be reduced as fewer parts are required.

The first embodiment given above described a construction in which a single paper shear prevention member 35 is provided; however, a construction in which a plurality of paper shear prevention members 35 are provided is also acceptable. A construction in which a plurality of paper shear prevention members 35 are attached to the paper supply cassette 7 of the paper supply unit 2 is also possible.

Although a copying machine was described as one example of the image forming device in the above embodiments, other image forming devices such as a facsimile, printer, or the like can also be used.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-367686. The entire disclosure of Japanese Patent Application No. 2004-367686 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A paper supply device for supplying paper to an image forming unit of an image forming device, comprising:

a paper supply device main unit;

a paper storage unit that stores multiple sheets of paper, and which is arranged in the paper supply device main unit;

a regulating member that regulates the width direction of the multiple sheets of paper stored in the paper storage unit;

a paper supply roller that feeds paper stored in the paper storage unit to the image forming unit; and a paper shear prevention member configured to prevent paper shear and arranged at a position above the multiple sheets of paper stored in the paper storage unit, the paper shear prevention member including a brush that makes contact with the surface of the paper stored in the paper storage unit, and a main unit having a curved portion that curves so as to project toward the paper side and forms a concave section on a side opposite the brush, the main unit and curved portion being integrally formed with each other to form a J shape, the brush being arranged to form an acute angle against the paper surface in the feeding direction of the paper and arranged from the end of the main unit through the curved portion.

2. A paper supply device according to claim 1, wherein the paper shear prevention member further includes an engagement unit on the base side of the main unit that rotatably engages with the paper supply device main unit, and wherein the brush is arranged up to at least an end of the main unit.

3. A paper supply device according to claim 1, wherein the paper shear prevention member is arranged in the approximate center of the paper storage unit in the width direction of the paper.

4. A paper supply device according to claim 1, wherein the paper storage unit is a manual feed paper supply tray that is mounted on the paper supply device main unit so as to be openable and closable.

5. A paper supply device according to claim 1, wherein the paper storage unit is a paper supply tray that can be freely attached to and removed from the main unit of the image forming device.

6. A paper supply device for supplying paper to an image forming unit comprising:

a paper supply device main unit;

a paper storage unit that stores paper, and which is arranged in the paper supply device main unit;

a regulating member configured to slide in a width direction of the paper and regulate the width direction of the paper stored in the paper storage unit;

a paper supply roller that feeds paper stored in the paper storage unit to the image forming unit; and a paper shear prevention member configured to prevent paper shear and arranged above the paper stored in the paper storage unit, the paper shear prevention member including a brush that makes contact with the surface of the paper stored in the paper storage unit, the brush being arranged to form an acute angle against the paper surface in the feeding direction of the paper, the paper shear prevention member being arranged on the regulating member, the paper shear prevention member being rotatably supported on the regulating member.

7. The paper supply device according to claim 6, wherein the paper shear prevention member is configured to slide with the regulating member in the width direction.

8. An image forming device, comprising:

an image forming unit that forms an image on paper;

a paper supply device that supplies paper to the image forming unit; and a fusing unit that fuses the image formed by the image forming unit onto paper, the paper supply device having a paper supply device main unit, a paper storage unit that stores multiple sheets of paper, and which is arranged in the paper supply device main unit, a regulating member that regulates the width direction of the multiple sheets of paper stored in the paper storage unit, a paper supply roller that feeds paper stored in the paper storage unit to the image forming unit, and a paper shear prevention member configured to prevent paper shear and arranged at a position above the multiple sheets of paper stored in the paper storage unit, the paper shear prevention member including a brush that makes contact with the surface of the paper stored in the paper storage unit, and a main unit having a curved portion that curves so as to project toward the paper side and forms a concave section on a side opposite the brush, the main unit and curved portion being integrally formed with each other to form a J shape, the brush being arranged to form an acute angle against the paper surface in the feeding direction of the paper and arranged from the end of the main unit through the curved portion.

* * * * *